US008517788B2

(12) United States Patent
Eck et al.

(10) Patent No.: US 8,517,788 B2
(45) **Date of Patent: *Aug. 27, 2013**

(54) METHOD AND SYSTEM FOR ARTICULATED CHARACTER HEAD ACTUATION AND CONTROL

(71) Applicant: Disney Enterprises, Inc., Burbank, CA (US)

(72) Inventors: Timothy J. Eck, Orlando, FL (US); William J. Wiedefeld, Clermont, FL (US); David Michael Hynds, Orlando, FL (US); Jeffrey R. Schenck, Clermont, FL (US); William Eugene Brasher, Clermont, FL (US); Brendan D. Macdonald, Colebrook, NH (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/742,509

(22) Filed: Jan. 16, 2013

(65) Prior Publication Data

US 2013/0130585 A1 May 23, 2013

Related U.S. Application Data

(63) Continuation of application No. 12/328,417, filed on Dec. 4, 2008, now Pat. No. 8,371,893.

(51) Int. Cl.
*A63H 33/00* (2006.01)

(52) U.S. Cl.
USPC ..... 446/26; 446/175; 446/330; 446/484; 472/57; 472/84

(58) Field of Classification Search
USPC ..... 446/330, 391–392, 26, 175, 484; 700/245, 257; 414/6–7, 9; 340/573.1, 999; 2/69, 905; 472/57, 70, 75, 84
See application file for complete search history.

(56) References Cited

U.S. PATENT DOCUMENTS

| | | | |
|---|---|---|---|
| 4,660,033 | A | 4/1987 | Brandt |
| 5,021,878 | A | 6/1991 | Lang |
| 5,142,803 | A | 9/1992 | Lang |
| 5,182,557 | A | 1/1993 | Lang |
| 5,198,893 | A | 3/1993 | Lang |
| 5,289,273 | A | 2/1994 | Lang |
| 5,845,540 | A | 12/1998 | Rosheim |
| 5,977,951 | A | 11/1999 | Danieli et al. |
| 6,016,385 | A | 1/2000 | Yee et al. |
| 6,500,041 | B1 | 12/2002 | Crome, Jr. |
| 2005/0148279 | A1 | 7/2005 | Maa |
| 2005/0287911 | A1 | 12/2005 | Schulze |

*Primary Examiner* — Dmitry Suhol
*Assistant Examiner* — Alex F. R. P. Rada, II
(74) *Attorney, Agent, or Firm* — Marsh Fischmann & Breyfogle, LLP; Kent A. Lembke

(57) ABSTRACT

A method for operating a driven output device provided in an articulated head, mobile prop, or other object worn by a performer. The method includes providing a wearable control system, the control system including a driver for the output device, a control module, a wireless receiver, and memory. The method includes storing a set of show control commands for the output device in the memory, and receiving a show control signal with the wireless receiver from a wayside controller. The method includes operating the control module to process the show control signal, to retrieve the show control commands, and to signal the driver to drive the output device based on the commands. The commands are selected based on a character identifier stored in memory associated with the output device such as in a character head junction box, and this memory stores tuning or configuration data for the output device.

26 Claims, 10 Drawing Sheets

METHOD AND SYSTEM FOR ARTICULATED CHARACTER HEAD ACTUATION AND CONTROL

REFERENCE TO RELATED APPLICATIONS

This application is a continuation of U.S. patent application Ser. No. 12/328,417 entitled "METHOD AND SYSTEM FOR ARTICULATED CHARACTER HEAD ACTUATION AND CONTROL," which was filed on Dec. 4, 2008 and is hereby incorporated by reference in its entirety.

BACKGROUND OF THE INVENTION

1. Field of the Invention

The present invention relates, in general, to costumes with portions that can be animated or articulated while worn such as character heads with a mouth and eyes that can be articulated or moved by a person wearing the head, and, more particularly, to systems and methods for providing more effective and interactive control over portions of a worn costume that can be articulated with local control by the person wearing the costume and with remote control by wayside or offstage controllers or control systems or a combination thereof.

2. Relevant Background

Actors, performers, or puppeteers wear costumes when they perform as a character such as in a live show, in a parade, in interactive entertainment settings, and in venues that call for a character to walk among and nearby audience members or guests. For example, costumes may include character heads that a performer wears on top of or covering their own head, and such character heads have been designed to allow motion of costume features such as to allow moving the mouth to move in synchronization to an audio output or the performer's voice. In other cases, the eyes may be moved or articulated and/or the eyelids may be opened and closed, and other features may also be moved such as expressive eyebrow movement. Such animation of the costume features and, particularly, of the head or face has been well received by audiences as the articulation or movement helps to bring the character to life and enhances the entertainment experience of the audience members or guests.

In a typical articulated character head, the mouth and eye motions may be provided with motorized motions. A performer may wear sensors on their fingers and their finger movements provide inputs or control signals (e.g., analog input signals) that cause a radio or remote controlled (RC) servo to move the portions of the costume such as to open and close a character's mouth or eyes when the performer moves their fingers. Generally, RC servos are battery powered and each RC servo includes a proportional servo amplifier, a DC motor, and feedback potentiometer within a single case, and a character head will include an RC servo and battery for each feature that can be articulated (e.g., two to five when the mouth, eyes, and eyebrows all move). In addition to control by the performer, RC controllers with joysticks, switches, and knobs similar or equivalent to the controllers used to control hobby cars and planes may be used to remotely control or operate the RC servos so as to allow someone offstage or "wayside" to wirelessly control facial movements or move other costume features by providing real time or live control signals.

Existing techniques for articulating character head and other costume features have proven the creative and technical feasibility and desirability of animating facial and other functions on a wearable costume. Unfortunately, there are a number of drawbacks to the existing costumes that has hindered or slowed their adoption by the entertainment industry. Existing technology is heavily reliant upon the skill and training of the performer wearing the costume or a wayside performer. The performer needs to be a puppeteer as they move their fingers of one hand (such as their dominant hand) to move the mouth in time with an audio track or their own speech and move fingers of their other hand to move the eyes or other features, and, while they are doing such articulation they may also need to be moving their body in a normal manner or even to provide a performance (e.g., puppet the head features while dancing). Such skills may only be found in a small fraction of performers and/or may require significant training, which can increase costs and limit widespread implementation of such costumes. Furthermore, existing wayside control techniques, such as wireless hobby RC transmitters and receivers operate via radio frequency (RF) transmission, which is prone to wireless transmission failure that may result in an unexpected character movement and a bad show.

Another limitation is that the character heads can become heavy as more RC servos are placed within the head. The use of RC servos may provide significant motor noise that limits use of such costumes to settings where the character will not be close to audience members who may hear and be distracted by the noises. The motors used now may also generate heat within the head, which can be an issue for worn costumes. The RC servos are often hobby grade devices, and there are concerns regarding the life and reliability of these devices. Further, the existing controller of the RC servos are typically analog and provide only a proportional rotary motion, which may not be precise or exact enough to replicate mouth or eye movements of a character. Existing costumes with articulated features also often require significant amounts of technician set up prior to each show that further limits adoption of such costumes.

Hence, there remains a need for improved methods and systems for worn costumes with features or portions that can be articulated or moved by a performer wearing the costume and in response to remote control signals or inputs. Preferably, such methods and systems would provide a more reliable and versatile costume with reduced noise, long life, and fidelity of motion.

SUMMARY OF THE INVENTION

The present invention addresses the above problems by providing methods and systems for providing enhanced control over the movement or articulation of driven output devices provided in articulated heads, costumes, and associated props (e.g., wearable costume features), e.g., RC servos, electromechanical actuators, and the like driving character eyes, mouths, and so on to animate a portion of a costume. The systems generally include a performer-worn control system that is communicatively linked to the output devices such as an actuator in a character head. The performer-worn control system may include drivers such as motor drivers for the output devices and power sources. Further, the control system includes a processor running a control module that controls operation of the driver to cause articulation or move the output device. To this end, the control module includes memory that stores sets of motion commands for portions of a show(s) for one or more show characters (or show entities). The control system also includes a wireless receiver, and during operation or a show, show control signals with timing cues/codes are transmitted to the receiver. The control module processes these show control signals to retrieve data suited for a particular character and issue driver control signals in a time synchronized manner, with the character's data chosen based on a character ID stored in memory associated with the detachable and exchangeable output device (e.g., memory in a junction box in a character head with one or more actuators). The control system may also be adapted to receive real time show control/motion signals from a remote or offstage controller (e.g., user input from a joystick or other control device) and also to facilitate local control such as analog input from finger sensors or the like to allow local puppeteering.

Hence, the performer-worn control system is a tri-modal control system with show data stored in memory (e.g., memory in a belt-pack controller or accessible by a control module running in such controller or other worn/supported controller). In some embodiments, operation of the output devices/actuators is enhanced by storing tuning/configuration data in the memory associated with the output device(s) such as homing settings establishing a range of motion for an actuator with endpoints offset from hard stops or the like. Storing show data for operating drivers/actuators in the worn control system provides a number of advantages. The storing of data locally (versus real time data transmission) improves reliability of an effect and enhances show quality. For example, if real-time data is used and is "cut" or lost, the costume (e.g., a mouth and eyes of a character head) is no longer animated. By storing show data locally, one of the problems of using transmitted data is overcome as a loss or cut of transmitted data (such as show control signals) may result in the performer-worn controller freewheeling at a predetermined or preset frame rate, and the show goes on using the stored data until the wireless time code or synchronization signal is again transmitted by the wayside controller and received by the worn controller.

More particularly, a method is provided for operating a driven output device provided in an articulated head, mobile prop, or other object worn or carried by a performer. The method includes providing a control system wearable by the performer, the control system including a driver for the output device, a control module, a wireless receiver, and memory. The method also includes storing a set of motion commands for the output device in the memory, and then receiving a show control signal with the wireless receiver from a wayside controller. The method further includes operating the control module to process the show control signal, to retrieve the set of motion commands, and to signal the driver to drive the output device based on the set of motion commands.

In some cases, the method may include storing additional sets of motion commands, with each of the sets of motion commands being associated with a single show character. Then, the control module may operate to identify the show character or entity associated with the control system and retrieving from memory the set of motion commands associated with the identified show character or entity. The method may include communicatively linking the control system with a memory device associated with the output device, and, in such cases, the identifying of the show character may include retrieving a character identifier from the memory associated with the output device. The memory associated with the output device may further be used to store a set of tuning parameters defining operation of the output device. Then, the control module may drive the output device based on the tuning parameters. The output device may include a motor driven actuator, and then the actuator includes a motor driver. The motor driven actuator may include a rotary motor with hard stops and soft offsets defining a distance from each of the hard stops, and the tuning parameters may include the soft offsets defining a range of motion for the motor driven actuator.

In the following description a wireless communication module is provided in or with the performer-worn control system (or controller) that is capable in some embodiments of receiving signals from a wayside or remote control system and also of transmitting signals back to the wayside control system. Hence, it may be called a wireless transceiver (e.g., wireless receiver is used interchangeably with this wireless transceiver). The uses of the wireless communication module and communications passed between the wayside control system and the worn control system may include checking/verifying: battery life, controller temperature, controller status, and/or actuator driver operation or fault status. The communications may also be used to allow the show control mode to be changed remotely as well as to allow remote capturing of performer's puppetry data and/or mapping one performer's puppetry data to another device or articulated head. In some embodiments, the system may be configured such that show data, whether stored onboard or being wirelessly transmitted to the worn control system, may include information to enable or disable live puppeteer control. This allows a preconceived interactive show, for example, to play back prescripted material or allows the performer to create performances on the fly. Furthermore, this capability of enabling/disabling can be controlled by the performer by operating an arm-mounted or otherwise provided control switch.

DETAILED DESCRIPTION OF THE PREFERRED EMBODIMENTS

Figure 1B:
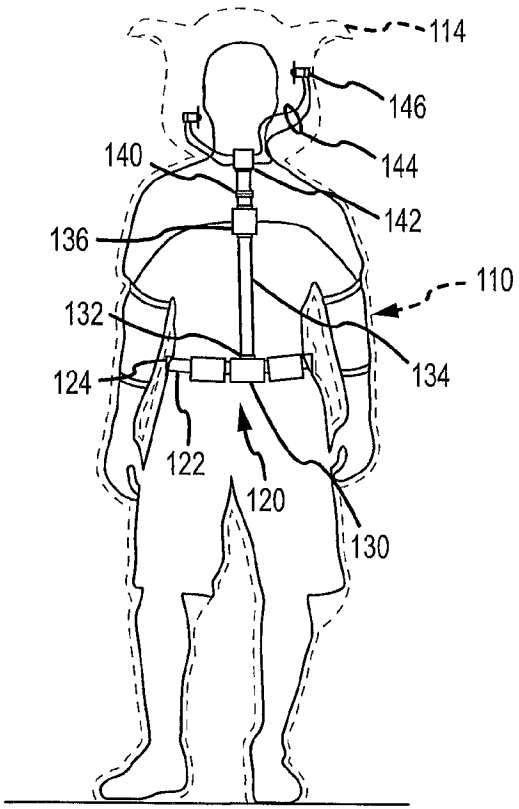
FIGS. 1A and 1B are front and back views, respectively, of costume worn by a performer or actor that is adapted for articulation or animation with a character head of an embodiment of the invention with a performer-worn articulation assembly or system (or interchangeably termed a local control or show controller system/assembly in this document)

Briefly, embodiments of the present invention are directed to methods and systems for providing enhanced control over the movements of movable or driven portions of worn character costumes or props associated with such costumes. The driven portions may, for example, include the mouth and eyes of a character head worn by a performer, and an actuator or similar output device may be provided in the character head to manipulate or provide motion of these costume portions or features. The methods and systems typically involve a control system that is worn (e.g., wearable) by the performer, and this control system includes drivers for the head actuators/motors, a control module, a wireless receiver for receiving show control signals from a remote location such as a wayside controller or offstage control system, and memory. The memory is used to store show data including sets of motions for a number of shows or show segments, and each of these show segments may be provided for a number or plurality of character costumes/character heads such that the performer-worn control system may be used interchangeably with costumes/heads. During operation, performers may use local, analog or other input devices to control the actuators or output devices so as to puppet desired movements. Also, during operation the wireless receiver may receive show control signals, and the control module may process these signals and respond by using the stored show data to signal/control the drivers to drive or articulate the output devices or actuators based on the defined motions (e.g., using information stored in the performer-worn control system). The show control signals may also include timing information that is used by the control module to synchronize operation of the character head or costume portions to an overall show or performance.

The following description provides a complete and detailed description of a tri-modal character head/costume control system and method that can be used in three operating modes including a local puppet mode where the performer is able to control movement of the character head/costume features or portions by controlling actuators or output devices. Another mode is real-time control in which an operator of a remote control station (e.g., with a joystick, keyboard, GUI, sliders, and the like) can control the costume by sending wireless show control signals to the performer-worn control system and processing by the control module. However, this operating mode may be computerized as well, e.g., the operator does not have to be a live operator. For example, the commands could be pre-stored or generated by a computer in real-time. In a third mode of operation, all (or a significant fraction of) the show control data is stored in memory provided in each performer-worn control system, and a wayside or offstage controller transmits show control signals that include time cues or codes wirelessly to the receiver of the performer-worn control system. These signals are processed and result in scripted motions or sets of motion commands to be retrieved and used to operate the character head/costume with drivers included in the performer-worn control system and communicatively linked/wired to the actuators/output devices.

Prior to describing exemplary embodiments of the performer-worn control system and other aspects of the invention, it may be useful to more generally discuss some of the advantages and features of an entertainment or show system that includes one or more performer-worn control systems. The inventors understood that it would be desirable to provide more reliable and quiet output devices, and, to this end, an actuator is provided that may be thought of as industrial grade rather than hobby grade as used in the past. This actuator is combined with relatively heavy, industrial motor drivers that are positioned within the performer-worn control system to move them away from the character head. The enhanced actuator assemblies create no mechanical noise at rest (e.g., prior devices often chattered even when not supposed to be moving) and only make minimal noise when they are moving, include motors that create minimal heat, and are expected to have a much longer service life. Control is significantly enhanced as scripted show portions are controlled digitally with a control module/assembly that is installed in the performer-worn control system (e.g., a belt pack or the like may be used to allow a performer to wear/carry the control system to avoid increasing the weight of the character head or costume). Exact and tunable motor stops may be provided to increase the accuracy of the movement of the actuator/output device to provide desired movement of the mouth, eyes, and/or other costume features. Generally, the performer or show technician would have no set up requirement as the control module is adapted to communicate with the attached character head or costume to retrieve the character head/costume's identification and configuration/tuning data. Hence, the control module is able to operate the actuators in the character head using the show data that matches that character head/costume (e.g., a show may have differing scripts for each character in the show) and using tuning/homing data earlier stored in memory provided in the character head/costume.

Figure 1A:
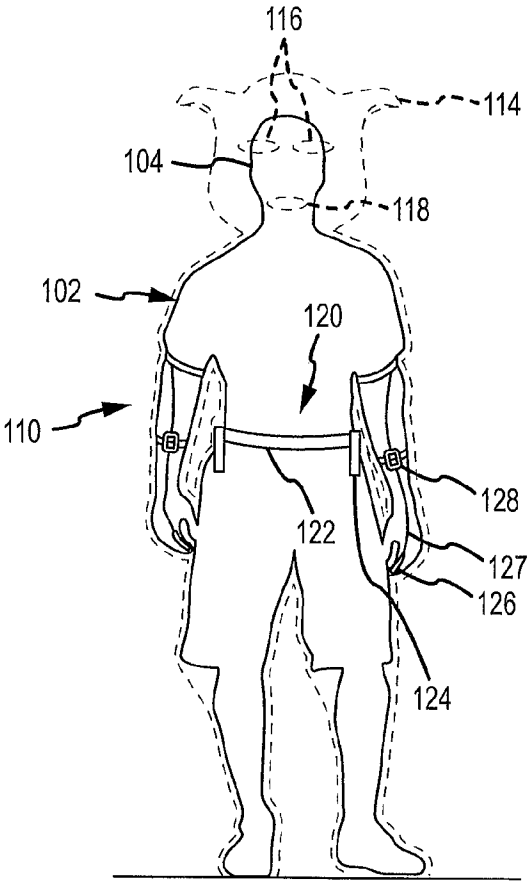

FIGS. 1A and 1B illustrate front and back views, respectively, of a performer 102 wearing a costume 110 (shown with dashed lines to provide a view of components normally covered/hidden from view) with movable portions. The performer also wears/supports a performer-worn control system/assembly 120. The control system 120 is operable to articulate and control motorized animated features on the mobile, self-contained costume 110 that includes a character head 114 over the performer's head 104 (or on top in other cases). These features, of course, may also be used with animated props or other drivable/moveable portions of a costume than those shown in FIGS. 1A and 1B. The system 120 allows performer/puppeteer control (e.g., by actions of the performer 104 inside the costume 110), interactive control by an off-stage system (e.g., by an operator or wayside device providing real-time show control signals transmitted wirelessly to the system 120), and/or on-board stored motion playback (e.g., in response to show control signals with timing cues being received at the control system 120).

As shown in this example, the character head 114 includes eyes 116 and a mouth 118 that are adapted to be moved or articulated when associated output devices or actuators 146 are operated by the control system 120. The performer-worn control system 120 is designed to be comfortably attached to or worn by the performer 102, and the system 120 includes a belt 122 for supporting a majority of the system components in an ergonomic manner. The system 120 includes one or more battery packs or other mobile power elements (such as miniature fuel cells or the like) 124 to provide power for the control system 120 components and the actuators 146 (rather than providing batteries in the head 114). To facilitate local control by the performer 102 or puppeteering, the system 120 includes one or more finger paddles 126, signal wires 127, and switch boxes 128 to allow the performer 102 to turn puppet mode on and off.

Figure 2:
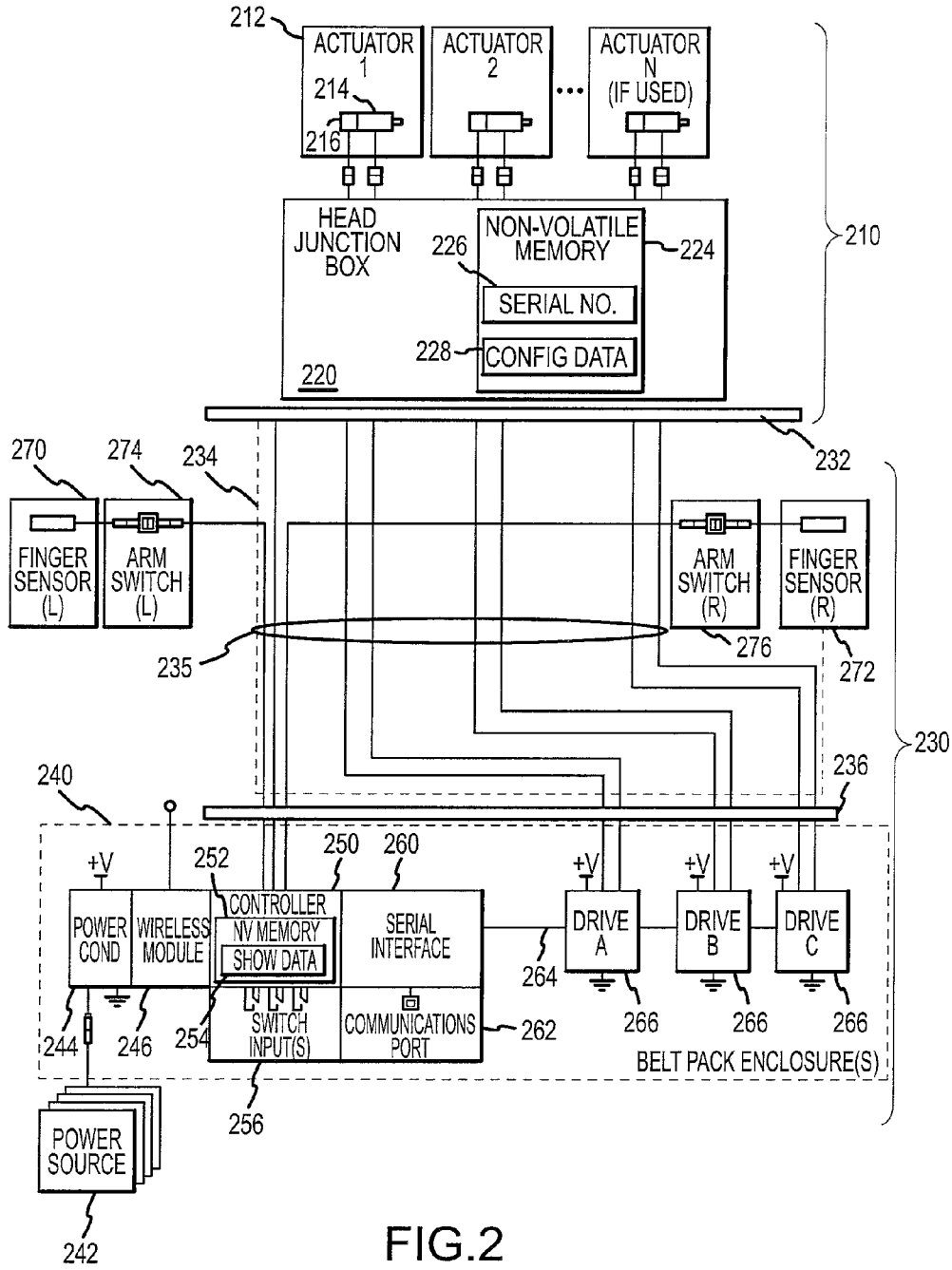
FIG. 2 illustrates schematically a performer-worn controller system or articulation assembly of an embodiment of the invention.

The control system 120 also includes a belt pack character controller assembly 130 provided on the belt 122, which may take the form shown in FIG. 2 or another form to provide desired functionality. The controller assembly 130 provides power and control signals to output devices such as actuators 146 and, to this end, a plurality of power/communication wires may be run from the controller 130 to the head (or costume or prop) junction box 142 via a wire harness 134, which is connected to the controller assembly 130 via a belt pack connection 132. The communication wires may also be used to allow the controller 130 to read data stored in the junction box 142 such as an ID of the head 114 (or other costume/prop portion) and configuration/tuning data (e.g., data obtained during homing operations to limit/control movement of the actuator 146 by the controller 130). The signal wires 127 from the analog performer inputs (e.g., finger paddles or the like) 126 may be run to the controller 130 via an optional splitter box 136 and harness 134, whereby the controller 130 is able to process these signals with a control module to operate drivers in the controller assembly 130 to drive the actuators/output devices 146.

The character head 114 may include an actuator for each driven portion such as for each of the mouth 118 and eyes 116, and the actuator may include a conventional RC servo or may include a specially adapted actuator as described herein with a gear reducer, a motor, an encoder, and modular or configurable stops (or exchangeable stops) selected for desired movements/ranges of motion. The head portion of the control assembly 120 includes a head junction box 142 linked by wires passing through the harness 134 and a head connection 140. The head junction box 142 is used to direct control and/or power wires 144 out to the various actuators 146. More significantly, the head junction box 142 may include memory or data storage that allows it to store ID information for the head 114 (or other costume portion or prop) and also store configuration information for the head 114 and/or actuators 146 (e.g., homing information including offsets from hard stops provided with each of the actuators 146). The controller 130 may read or access the ID information and configuration data to select corresponding show data to use in controlling operation of the actuators 146 and also to allow the controller 130 to effectively process show control signals and analog performer input to generate actuator control signals that it transmits to the actuators 146. With these performer-worn components understood, it may now be useful to discuss in more detail particular components and devices that may be used in a practical implementation of the invention.

FIG. 2 illustrates schematically a performer-worn controller system or articulation assembly of an embodiment of the invention. The assembly may be thought of as being separated into a costume portion 210 and a control portion 230 that are joined via a junction box 220. For example, the costume portion 210 may include components mounted in a character head, a portion of a costume, and/or a prop tethered or otherwise associated with the control portion 230, and the junction box 220 may be adapted for ready connection of power/control wiring from the control portion 230 to wiring/devices in the head, prop, or costume portion 210 via a connector/connection assembly 232 (e.g., a connection that may allow a character head to simply be plugged into/together or otherwise attached to the control portion 230).

As shown, the costume portion 210 includes an actuator 212 for each portion of the costume that is driven or moved during operation of the system 200. For example, an actuator 212 with a motor 214 and an encoder 216 may be provided for a mouth and for each eye in a character head 210. The costume portion 210 may include a junction box 220 with non-volatile memory 224 connecting each actuator 212. The non-volatile memory 224 is provided to store data specific to the costume portion that allows the costume portion 210 to be used interchangeably with the control portion 230 and also to allow the control portion 230 to more effectively control operation of the actuators 212. In the illustrated example, the memory 224 is used to store a serial number or other identifier 226 for the costume portion 210, e.g., for a particular character's head, and this information may be tied or linked to a set of show data to control motions of the character (e.g., to tie the movement of one character's lips/mouth to their speech or singing during a show, which would typically differ from another character's movements). Additionally, configuration data 228 may be stored in memory 224, and this information may include range of movement information for an actuator (e.g., hard stops provided with a range of motion of 60 degrees but offsets of 2 degrees used to set a range of motion of 56 degrees or the like).

The control portion 230 includes control enclosures (e.g., belt pack or similar enclosures) 240 that may be attached to or worn by a performer. The performer typically will wear or carry a power source for the control portion components and/or the actuators 212, and FIG. 2 shows one or more batteries 242 providing DC power to a power conditioner(s) 244 in the control enclosure 240. The control enclosure 240 also includes a wireless receiver and/or module 246 that allows the control portion 230 to receive wireless signals including show control signals from remote or wayside controllers. A number of drivers 266 such as motor or servo drives are provided in the enclosure 240 and linked via connecting wires 235 running through body harness cables 234 (or course, other wiring harness cables may be used such as a data bus having reduced wire count (e.g., serial data buses, Ethernet, CAN, proprietary products, or the like)) and connectors 236 and connectors 232 (e.g., water resistant connectors) with the costume portion 210.

The control portion 230 also includes a controller 250 that may include a processor managing operation of a control module to process incoming show control signals, to select show data, and to transmit control signals via serial interface 260 and serial connection 264 to drivers 266. An optional Ethernet or other communications port 262 may be provided along with or instead of switch input(s) 256 to allow the controller 250 to receive and process other inputs in addition to the show control signals from module 246. For example, show data may be downloaded to the controller 250 via port 262. The processor of controller 250 may also manage operation of non-volatile memory 252 to store and retrieve show data 254, which typically defines a set of motions for one or more characters (associated with serial numbers 226) and/or one or more shows. The controller 250 may also include other components (hardware and/or software components) that allow it to provide the functions/operations described herein such as digital I/O devices, A/D converters, and the like.

The control portion 230 also includes analog or performer input devices linked to controller 250 including finger sensor(s) 270, 272 worn on the hands of the performer to allow the performer to provide local, real time proportional control of the actuators 212. Other control sensors may be included such as mouth controls, breath 'puff' controls, eye tracking controls, and so on with the ones shown only being examples and not limitations. Switches 274, 276 are also provided to allow the performer to select when the signals from the sensors 270, 272 may be transmitted to the controller 250. The controller 250 processes the received analog signals and, in response, operates the drivers 266 to drive the actuators 212 and move corresponding portions of the costume (e.g., move a mouth and/or eyes of a character head). The controller 250 is operable to support performer puppeteering/articulating of the actuators 212 with the finger paddles 270, 272 and also to support movement of the costume portion 210 based on show control signals received by the wireless module 246, which allows remote real-time control and show/scripted movement playbacks by retrieval of the show data 254 based on time code or the like.

Figure 3:
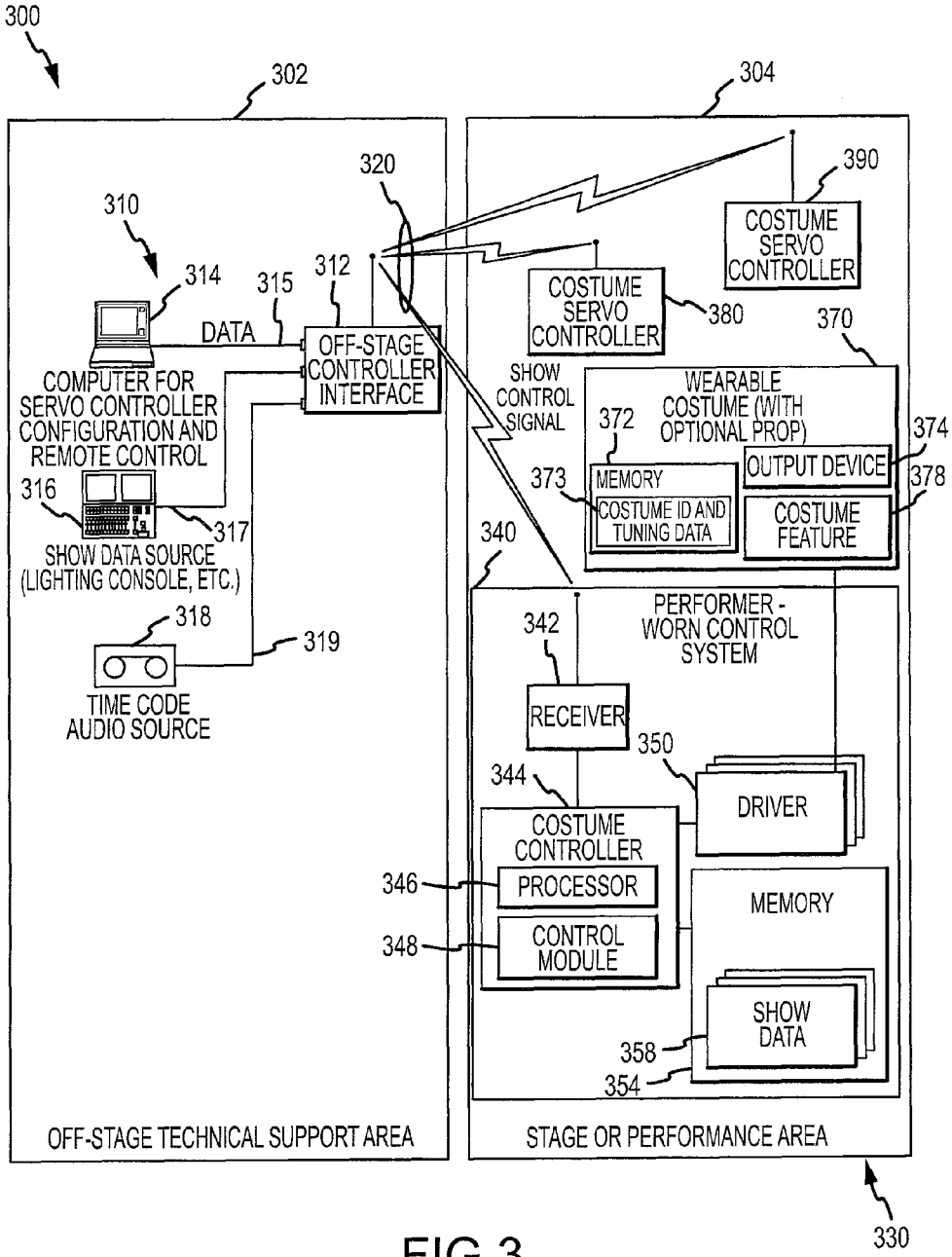
FIG. 3 illustrates a functional block diagram of an entertainment or show system that includes one or more performer-worn control systems for responding to wayside show control signals to drive features (such as a mouth or eyes) of a wearable costume or head.

FIG. 3 illustrates a functional block diagram of an entertainment or show system 300 that includes one or more performer-worn control systems 330 for responding to wayside show control signals 320 to drive features (such as a mouth or eyes) of a wearable costume or head 370. The system 300 may be divided into an off-stage technical support or control area 302 and a stage or performance area 304 where performers may present a show and/or interact with audience members. A wayside control system or assembly 310 is positioned in the off-stage technical support area 302 and performer-worn control systems 330 along with wearable costumes with or without tethered or linked props 370 are typically located in the stage or performance area 304.

The wayside system 310 supports remote control or operation of a costume feature 378 such as character head mouth or movement of a prop by operation or actuation of an output device 374 (e.g., an actuator) provided on or within a costume 370 wearable or supported by a performer such as a costume with a wearable character head. To this end, the wayside system 310 is shown to include a real-time control portion 314 that may include a computer for providing remote control data 315 to an off-stage controller interface 312, which in turn transmits the data as a show control signal 320 to the performer-worn control system 340 (or other costume-based controllers 380, 390). The real-time control portion 314 may, for example, include a user interface displayed on a computer monitor along with I/O devices such as joysticks that in combination allow an operator to generate control input data 315 for the control system 340 to use in operating the output devices 374. Of course, the computer 314 does not have to be taking in real-time input but may be sending previously recorded data out to performer-worn controllers for real-time control. The control portion/device 314 may also be used by an operator to input servo controller configuration data and/or for use in tuning/configuring the output device 374 (as discussed below), and such data may be stored at the wearable costume 370 (such as in memory in a head or other junction box) and/or in the performer-worn control system 340. The wayside control assembly 320 also includes sources 316, 318 of timing information/signals connected to controller interface via lines 317, 319, and the timing information/signals may be conventional lighting control signals, audio time stamp, or other data useful for synchronizing control of drivers 350 associated with output devices 374 (e.g., the show control signals 320 may include time stamps and/or timing cues). The time codes or cues may be provided in the show control signals and then used by control module 348 in operating the drivers 350. The show control signals 320 may also include information or payloads that identify which show to perform or which set of motion commands to retrieve and playback via drivers 350. The show control signals 320 may be broadcast to all receivers/controllers 342, 380, 390 within the performance area 304 and may be directed to all characters or to a subset of such characters (e.g., include a field or tag that indicates which characters are to process the signal 320).

As shown, the performer-worn control system 340 includes a wireless receiver 342 operable to receive the show control signals 320. The system 340 also includes a costume servo controller 344 with a processor or CPU 346 that runs a control module 348 to process the show control signals 320 and, in response, to operate one or more drivers 350 to drive motors or actuators 374 to move a costume feature 378. The wearable costume 370 may include memory 372 that stores a costume ID 373 that the control module 348 may read from memory 372 of the wearable costume 370 (e.g., the wearable costume 370 may include a detachable portion such as a character head or the like with separate memory devices 372). The memory 354 of system 340 may be used by controller 344 to store one or more sets of show control commands or show data 358. During operation, the control module 348 may act to receive a show control signal 320 indicating a particular show or show segment to perform along with timing or synchronization information. The control module 348 may then read the costume ID 356 or retrieve this data if not already stored. This data may also include configuration and/or tuning data for the particular output device 374. The control module 348 may then retrieve the appropriate set of motion commands for the show and character/costume associated with the ID 356. Using the tuning data, the motion commands, and the timing information, the control module 348 acts to operate or drive the output device 374 and connected costume feature 378 via the drivers 350.

As can be seen from FIGS. 1-3, a method is provided to articulate and control motorized animated features on a mobile, self-contained character costume, character head, animated prop, puppet, and the like. The systems allow a performer/puppeteer to control the driven portions of the costume from within the costume, allow interactive control by an operator of an off-stage or wayside system, and allow playback of onboard-stored motion commands in response to a show control signal (e.g., with time codes/cues). The wayside system may also be used to provide playback (or remote control) of wayside stored, pre-recorded content or show data. Embodiments of the system may include a waist-mounted character controller, off-stage wayside controls, and show control sources. The character controller is typically carried by the performer along with a costume. The character controller includes a mobile power source with power controls, a character control module, a wireless interface, servo amplifiers, wire harnesses, and connectors. The character control module operates actuators in the character head to control various animation functions (or other driven portion of a costume or associated prop). An actuator of an embodiment of the invention may include a gear reducer, a motor, a position feedback, optional feedback devices, and a configurable hard-stop homing mechanism.

The off-stage or wayside controls may include a wireless interface to multiple character controllers and provide an interface to show control sources. The show control sources may provide real-time control signals to manipulate multiple characters such as during rehearsals and programming sessions that may be used to define a set of prerecorded motions for a particular actuator or output device (e.g., based on a real-time control during a show rehearsal accurate lip synching movement of a mouth may be defined and these movements may be captured and stored as show data in memory accessible by a control module in a performer-worn control system). The show control sources may also provide synchronization with other show elements during show playback. For example, real-time control signals may be generated by off-stage manual controls (e.g., joysticks, sliders, and the like) or the control signals may originate via an animation controller. Synchronization may be provided with a DMX512 or similar controller or may be provided via SMPTE or an EBU time code input to the off-stage controller interface, which may process this data to generate the show control signals.

In one embodiment, the performer-worn character controller includes control electronics, motor drives, memory, indicators, control interfaces, and power management, and it is designed for use with a character costume with N-axes of motion. The character controller may include non-volatile memory for storing all control software to be run/used by a processor in the controller, for storing configuration/tuning settings retrieved from a connected costume portion (e.g., an attached/connected character head), and also for storing show data. Preferably, each character controller is capable of operating in a number of operating modes. In a local puppeteer mode, a costumed performer is able to control the axis motions from manual controls in the costume, e.g., motion control of actuators using analog finger sensors or paddles. In a remote data mode, off-stage equipment is used to send real-time axis motion commands to the character controller such that a remote operator or puppeteer may control driven/articulated portions of a character head or costume. In a show playback mode, off-stage equipment may send show control signals including synchronizing signals/data to the character controller so that axis motions that are pre-programmed or stored in on-board controller memory may be played back so as to be synchronized with show lighting, show audio, or other show features such as with movements being performed by output devices in other costumes in the show.

The character controller may include connectors for a removable, mobile power source, a wire harness, and several data links including a wireless link. The wire harness provides connections from the controller module to a junction box mounted in the character head (or other costume portion), to performer arm-mounted control switches, and manual controls (e.g., two or more performer finger controls). In a character head implementation, the junction box may be mounted in the character head and is used to connect the controller module to head-mounted actuators. This connection includes a path for each motor's drive and feedback signals. The junction box also includes non-volatile memory for storing character head specific configuration parameters such as character ID. The wire harness link from the junction box to the controller module provides a data link for reading and writing to this memory. The stored parameters (e.g., configuration and/or tuning parameters) in the head-mounted junction box memory allow any belt pack or other worn control system the ability to interface with any articulated character head (or other worn costume with driven/articulated portions or features). All pre-programmed character data for a given show may be stored in a plurality of character controllers or control systems such that the costumes and control systems may be mixed and matched. When playing back on-board show data (e.g., in show playback operating mode), the character controller plays back data corresponding to the particular character ID read from a connected character head or costume.

In some embodiments, local operating mode or puppeteering is provided with each or some of the performer-worn control systems. In such embodiments, each performer finger control may be used to manually command the positions of one or more axes of motion of the output devices or actuators associated with costume features. These controls connect through the arm-mounted control switch modules to the wire harnesses. The two arm mounted control switches are located with one on each performer arm. One switch may provide a master power disconnect signal to the control power source while the other switch's function may be under software control. These modules may also allow connection of the optional manual finger controls to the wire harness.

At this point, it may be useful to discuss some of the advantages provided by embodiments of the performer-worn control systems. These systems and their operating methods provide a new and unique design, layout, and distribution of character worn devices (e.g., power source, belt pack with control module, drivers, and memory storing show data/motion command scripts, and a wire harness) rather than providing all features in the character head. As discussed below with reference to FIGS. 4-9, a new electromechanical actuator may be provided in the character head or other costume portion to provide increased reliability and more accurate motion control. The head or costume junction box (or equivalent structure) allows motor and/or encoder signals to be terminated and, more significantly, provides memory storing configuration data, character/costume ID and/or serial number. The method of operating the control system includes storing and retrieving the configuration data from the junction box via a communications link with the belt pack or worn character controller.

Another important and/or unique aspect of some embodiments of the invention is the use of memory to store venue show data for access by the character controllers. When the controllers are later coupled to costume or character head, the character controller is able to calibrate/configure the output device or actuator using the configuration data in the junction box memory and also to use the character ID to retrieve associated show data in response to receiving show control signals. Aspects of the inventive system provide the ability to inventory and distribute character heads/costumes as each performer-worn control system is designed for interfacing with any articulated character head/costume. The performer-worn or belt pack control systems combine show control processing, memory with motion command show data, wireless radio, industrial motor drives, and associated environmentally protective enclosure and connectors.

Embodiments of the invention provide tri-modal operations with local performer control allowing for any analog sensor input, remote wireless control for rehearsal, interactive, and/or programming purposes, and show playback such as utilizing a low bandwidth show control time code signal to trigger synchronized playback of show segments stored on each character controller. Embodiments of the control systems include architecture or framework to modularly add actuators and motor drives to support differing applications (e.g., differing character head designs, differing props with features that may be animated or articulated with an actuator or other output device, and the like). Embodiments may include a module wireless system with wayside broadcast devices transmitting (e.g., show time code data or real-time position data) to N character receivers to suit a particular show or entertainment venue. The wayside control source interface (e.g., the device that transmits the show control signals) may be adapted to accept industry standard signals (e.g., SMPTE, DMX, and the like) and then act to translate the information in these signals and transmit the data stream to the character controller receivers in show control signals. The wireless system may be electronically isolated to a range of adjacent venues with equivalent devices (e.g., to provide no venue overlap or "bad show" results due to wireless interference or improper control of head or costume features that are driven improperly based on other show control signals). The aspects described herein may be applied to nearly any mobile or worn device with aspects or features that are driven or articulated by actuators or other output devices such as animatronics, puppets, animated props, lighting effects, and atmospheric effects while a major area of interest is worn costumes that have aspects or features such as eyes, ears, mouths, and so on that can be moved or driven to move to create a desired effect (such as to cause a character to appear alive or animated with movements synchronized with audio or other show elements).

The actuators or output devices provided in the character head and driven by the performer-worn control system may vary widely to practice the invention. For example, conventional RC servos may be used to practice the invention with or without modification. In other cases, though, a specially adapted actuator may be used to provide improved control of the movement of the costume or head feature. For example, an electromechanical rotary actuator with limited angle movement may be used such as an actuator with a selectable/interchangeable hard stop as the actuator 400 shown in FIG. 4. Such actuators may be adapted to facilitate tuning or homing, and then storing such tuning parameters or data in the head or costume junction box memory as discussed above for use in later operating the actuator with the performer-worn control system.

Such an electromechanical rotary actuator may be desirable for use in a worn costume application to address problems or disadvantages with using conventional RC servos. Conventional RC servo motors are a convenient and typical method to animate proportionally controlled animatronic or puppet functions. Generally, an RC servo motor includes a DC motor, a spur gear train, an internal potentiometer, and an internal electronic feedback system. RC servo motors have a very high power density such that the power per unit mass or unit volume is often excellent. Furthermore, on-board electronics allow a simple pulse-width modulated (PWM) input signal from external devices to provide position commands to the motor. RC servo motors are designed and built mainly for the hobbyist market such as for remote control cars, boats, and airplanes. As a result, to obtain an ideal operating point (e.g., peak torque at peak speed), the prime mover, which is typically a brushed DC motor, performs inefficiently producing great power at the risk of a shortened servo life. The resulting RC servo also produces heat, lacks industrial reliability, is loud (e.g., due to spur gear trains and electronic chopping amplifiers), and does not provide absolute or incremental position feedback to a motion control system.

Hence, the inventors determined that while RC servos work in some applications of the present invention, there are many applications such as where the audience members are nearby and so on where an improved or different actuator may be desirable for use as the output device in the systems of the invention. It would be desirable for such actuator to be about the same size or smaller than existing RC servos while providing industrial level operations. Such an actuator preferably would have a high power density, be efficient, be quiet for close-proximity entertainment applications, be reliable, provide high duty cycle, be enclosed to protect it from the environment, and be adapted to provide a closed loop incremental and/or absolute feedback. Further, it may be useful for this actuator to be a limited angle, rotary electromechanical actuator that has a configurable, repeatable range of motion such as to provide aesthetic animated functions or other applications requiring precise proportional movement.

Figure 4:
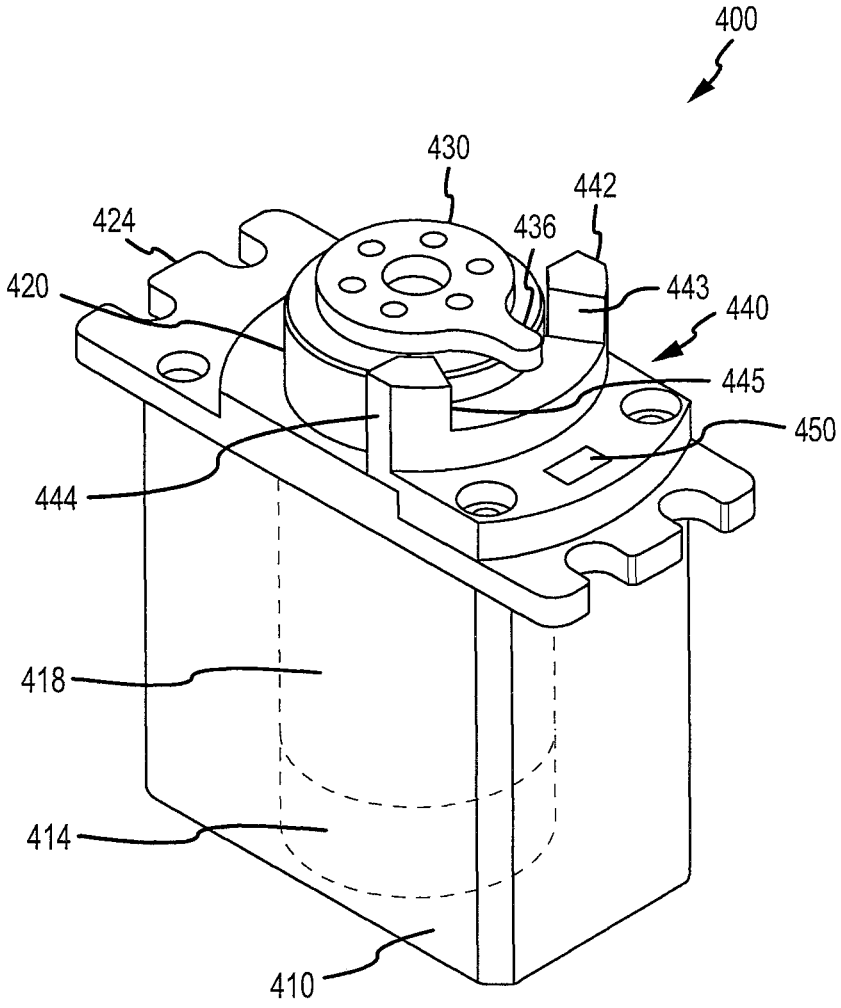
FIG. 4 is perspective view of one embodiment of an actuator for use in a worn character head or costume to provide enhanced control over motion or articulation of a portion of the head or costume (or tethered/linked prop)

FIG. 4 illustrates an actuator 400 that may be provided as the output device or actuators in the costumes/heads and props described herein. The actuator 400 may be thought of as including a small electromechanical power train with a unique hard-stop, homing configurable, modular mechanism 440. The actuator 400 is controlled by a control module (e.g., a software program run by a processor in a character controller, digital motion controller, or the like) such as shown in FIGS. 1-3. The actuator 400 includes a housing or enclosure 410 that environmentally protects and encloses an encoder 414 and motor 418, and the motor 418 is connected to a gear head 420. A mounting bracket 424 (e.g., a bracket with mounting features that make it compatible with typical RC servos) is provided on one surface of the enclosure 410 and surrounds the protruding gear head 420.

Nearly any rotational electromechanical actuator may be used to practice the invention such as (or in combination with) a variety of incremental encoders, a motors (AC or DC), and gear heads. In one embodiment, for example the encoder 414 is an incremental encoder, the motor 418 is a brushless DC motor, and the gear head 420 is a harmonic drive gear head. Use of a harmonic drive gear head allows for a high reduction (e.g., 100 to 1) in a very small volume that matches typical RC servo volume. Coupling a harmonic drive gear head 420 with an appropriately sized DC motor 418 provides a higher power density than most or all RC servos. The flange mounting plate or bracket 424 allows the actuator 400 mounting to fit within industry standard RC servo mounting hole patterns, which allows the actuator 400 to be used in retrofitting on existing equipment (such as character heads) that use RC servos.

The actuator 400 includes a hard stop assembly or element 440 that includes a paddle body 430 from which an arm or paddle 436 extends outward. The paddle body 430 is mounted upon the top of the gear head 420 that extends out from the bracket 424 and rotates with the gear head 420 and with any attached or connected character head or costume feature (e.g., a drivable or articulable feature such as eyelid or mouth) (not shown in FIG. 4). The stop assembly 440 also includes a stop plate or base 450 attached to the mounting bracket 424. The hard stop element 440 includes a pair of spaced apart posts/stops 442, 444 with inner stop faces or contact surfaces 443, 445, and the paddle 436 is positioned to be within this space or stop race (or travel path). The stops 442, 444 may be configured such that the stop surfaces 443, 445 define range of travel or an amount of angular movement or rotation for the gear head 420 by limiting or providing hard stops for the paddle 436 (with 57 degrees shown in FIG. 4 as an example but not as a limitation as this may be nearly any useful amount of travel such as 10 to 70 degrees or the like).

The provision of the paddle 436 and the stops 442, 444 in the modular/exchangeable hard stop element 440 allows the actuator 400 to operate as a limited angle rotary actuator using a constantly rotating motor 418. As shown, the cantilevered crank arm or paddle 436 is attached via plate 430 to the harmonic drive gear head 420, and during operation, the paddle 436 travels within the mechanical limits defined by the contact surfaces 443, 445 of stops 442, 444. The stop element 440 with stops 442, 444 may have a machined geometry with a unique range of motion (or angular rotation) that attaches to the bracket 424 such as with two fasteners or the like. The linkage or drive arm/assembly may then be mechanically attached or linked to the output flange 430 or to the shaft of the gear head 420 to which the paddle plate 430 was fastened. Because the paddle 436 is rigidly fastened and, hence, integrally linked with the load of the actuator 400, the range of motion of the actuator 400 is controlled by the stops 442, 444 and can readily be defined or changed by exchanging the stop element 440 with another with stops 442, 444 with differing configuration and/or spacing to provide a different range of motion. While physical or hard stops are shown in the actuator 400, some embodiments may utilize other stop mechanisms such as limit or proximity switches.

The actuator 400 may be paired with a digital motor controller such as a control module as described above provided in the performer-worn control system. The motor controller may include a software configurable, single channel digital motor drive/amplifier that is capable of brushless motor, closed-loop position control. The motor controller may be commanded by a torque, position, or velocity command via serial or analog input signals. The motor controller may also be adapted to be capable of current sensing proportional to the load induced on the motor.

Through editable software stored on the digital motor controller (e.g., a control module), the motor and attached paddle may be commanded to slowly rotate and make physical contact with the stop until the current and position error rise above a predetermined threshold. At that point, the motor may be commanded to stop and reverse direction for a predetermined number of encoder counts (e.g., to establish Offset 1). The same procedure may be repeated for the other direction of travel (e.g., to establish Offset 2). When this routine is completed, the actuator is "homed" and will rotate per a given motion command within the effective range of motion between Offset 1 and 2 rather than to simply contact the stops.

Figure 5A:
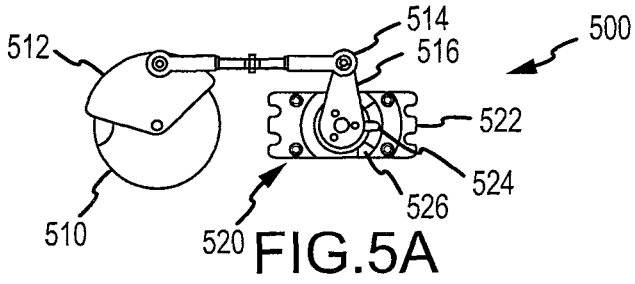
FIGS. 5A-5E illustrate an actuator, such as the actuator of FIG. 4, used for providing controlled movement of an eyelid and showing a homing process that may be used to define tuning or configuration data for the actuator (which may be stored in memory of a character head or costume for later retrieval or reading by a controller in a performer-worn controller assembly)
Figure 5B:
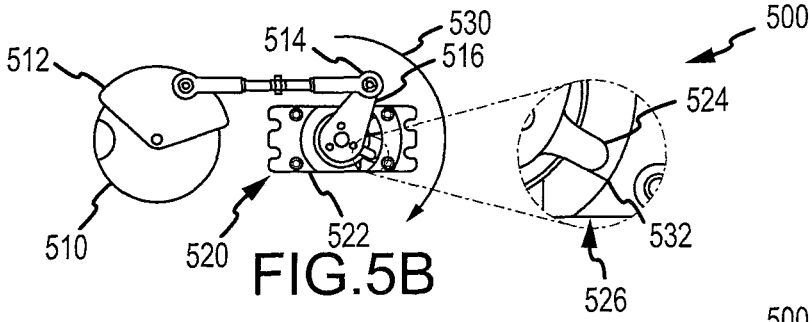
Figure 5C:
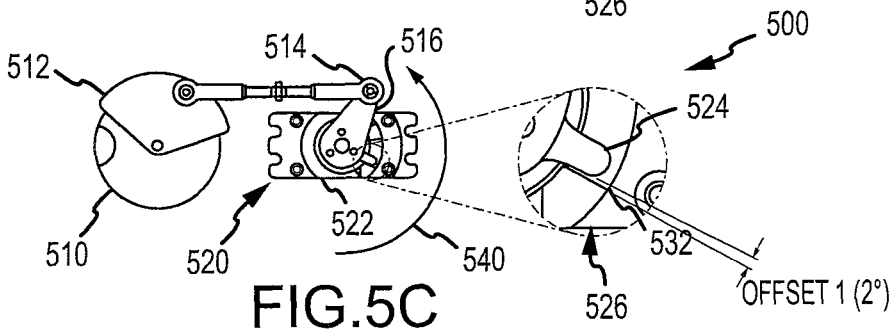
Figure 5D:
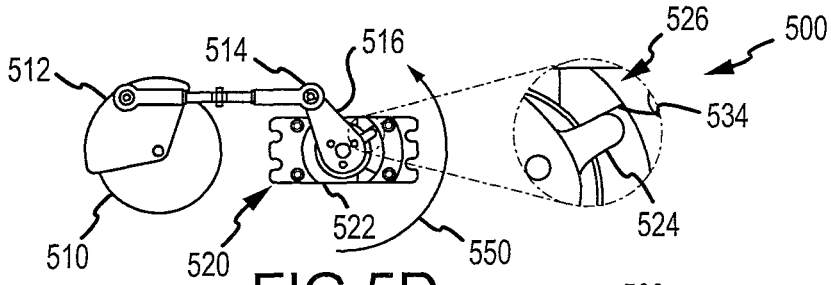
Figure 5E:
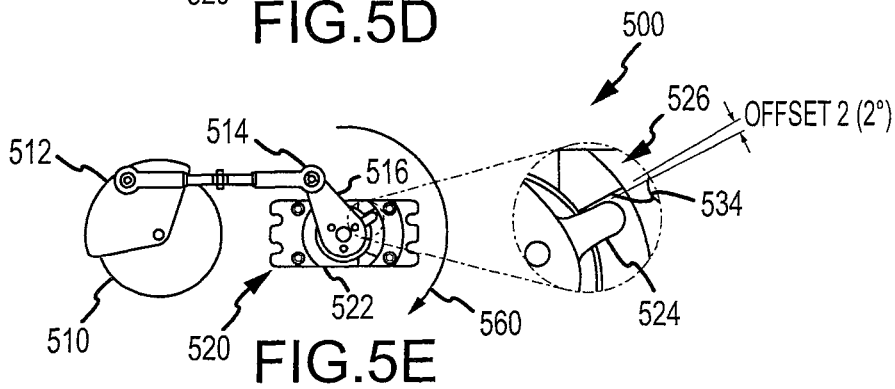

One exemplary homing process is shown in FIGS. 5A-5E for an eyelid mechanism 500. As shown, the mechanism or assembly 500 includes an eye (that may be stationary) and an eyelid 512 that can be pivoted about an axis to open or close the eye 510 (uncover and cover the eye 510). An actuator 520 is included in the eyelid mechanism 500 (e.g., the actuator 400 of FIG. 4 or the like) with a mounting plate 422, paddle 524, and stops 526 shown in FIGS. 5A-5E. A linkage/connector assembly including a linkage 514 and crank 516 is used to connect the actuator 520 to the eyelid 512 (e.g., to link the output device/driver 520 to the costume feature or portion that can be driven, moved, articulated, or the like). In this homing example, FIG. 5A shows the eyelid assembly 500 in a first or power up position with the eyelid 512 at an arbitrary angle and paddle 524 at some position between the stops 526. FIG. 5B shows the motor and its gear head being rotated 530 clockwise such that the paddle (and attached crank 516 causing lid 512 to move) rotates until it contacts and senses a first one of the stops 526 at surface 532. In FIG. 5C, the process of commanding Offset 1 is shown and establishing the offset distance/rotation from stop surface 532 with a small counterclockwise rotation 540 (e.g., Offset 1 is set at about 2 degrees in this example). FIG. 5D shows the motor and attached paddle 526 being rotated 550 counterclockwise until the stop contacts a second one of the stops 526 at surface 534 (e.g., to sense the second or opposite stop 526). In FIG. 5E, the actuator 520 has Offset 2 commanded and established with clockwise rotation 560 including a small rotation (e.g., about 2 degrees) moving paddle 524 from surface 534. At this point, the homing is complete, and the eyelid range of motion within defined offsets (i.e., Offset 1 and Offset 2) is ready for use in animation or motion commands (e.g., for use in playback of scripted motion commands in a set of show data for a character with the eyelid mechanism). This tuning or homing data may be stored in memory of a head junction box or other costume component or feature when the assembly 500 is not positioned in a character head.

Figure 6:
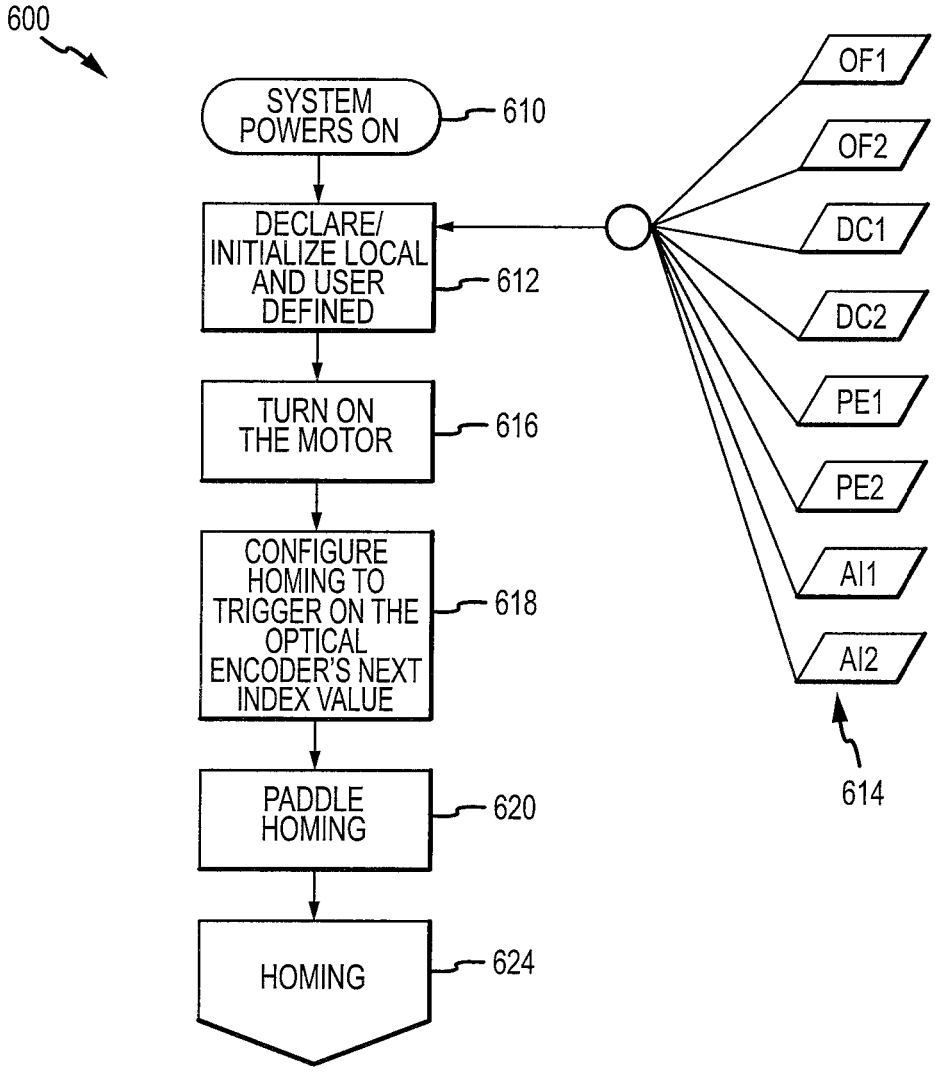
FIGS. 6-8 illustrate an actuator homing process of an embodiment of the invention.
Figure 7:
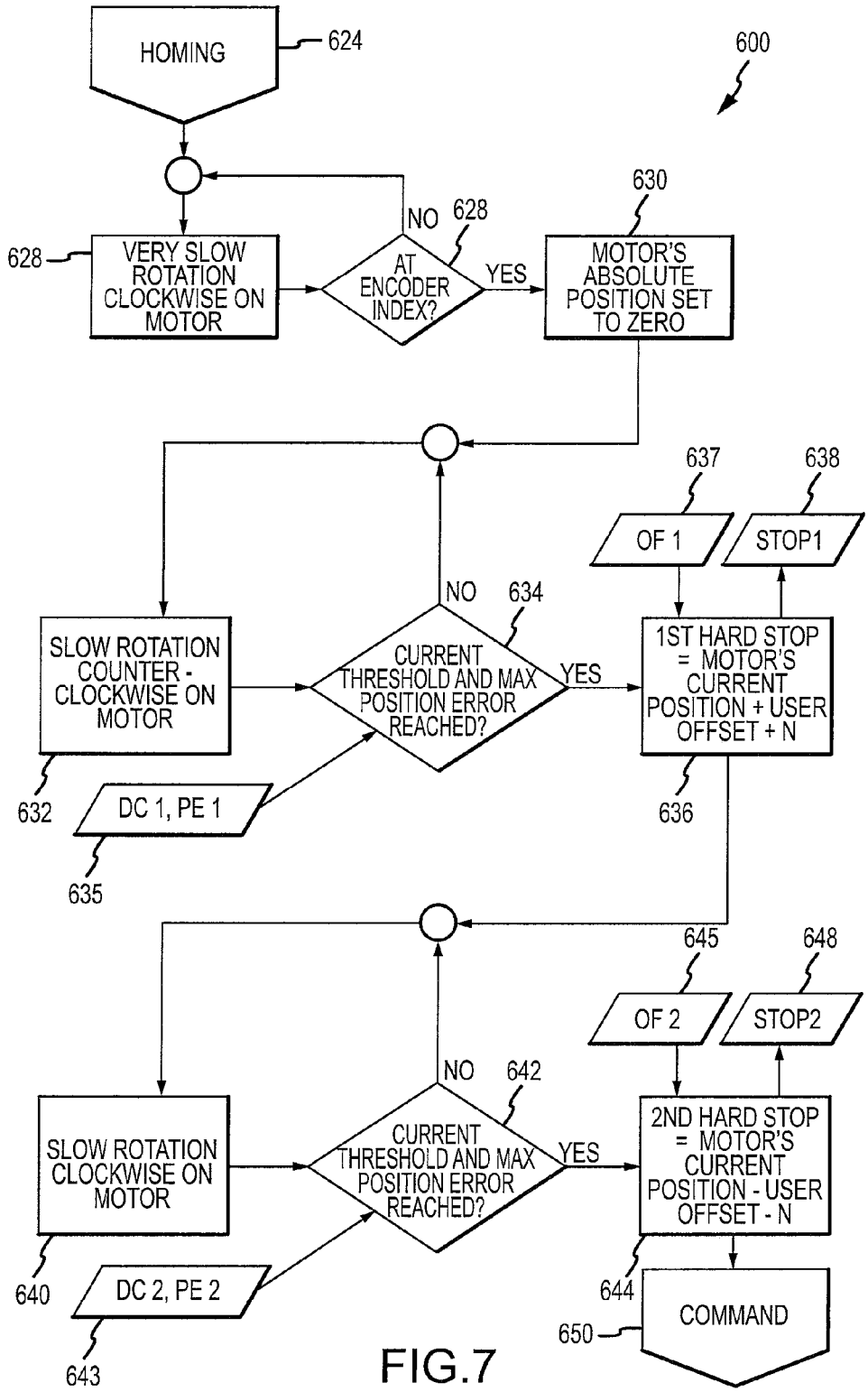
Figure 8:
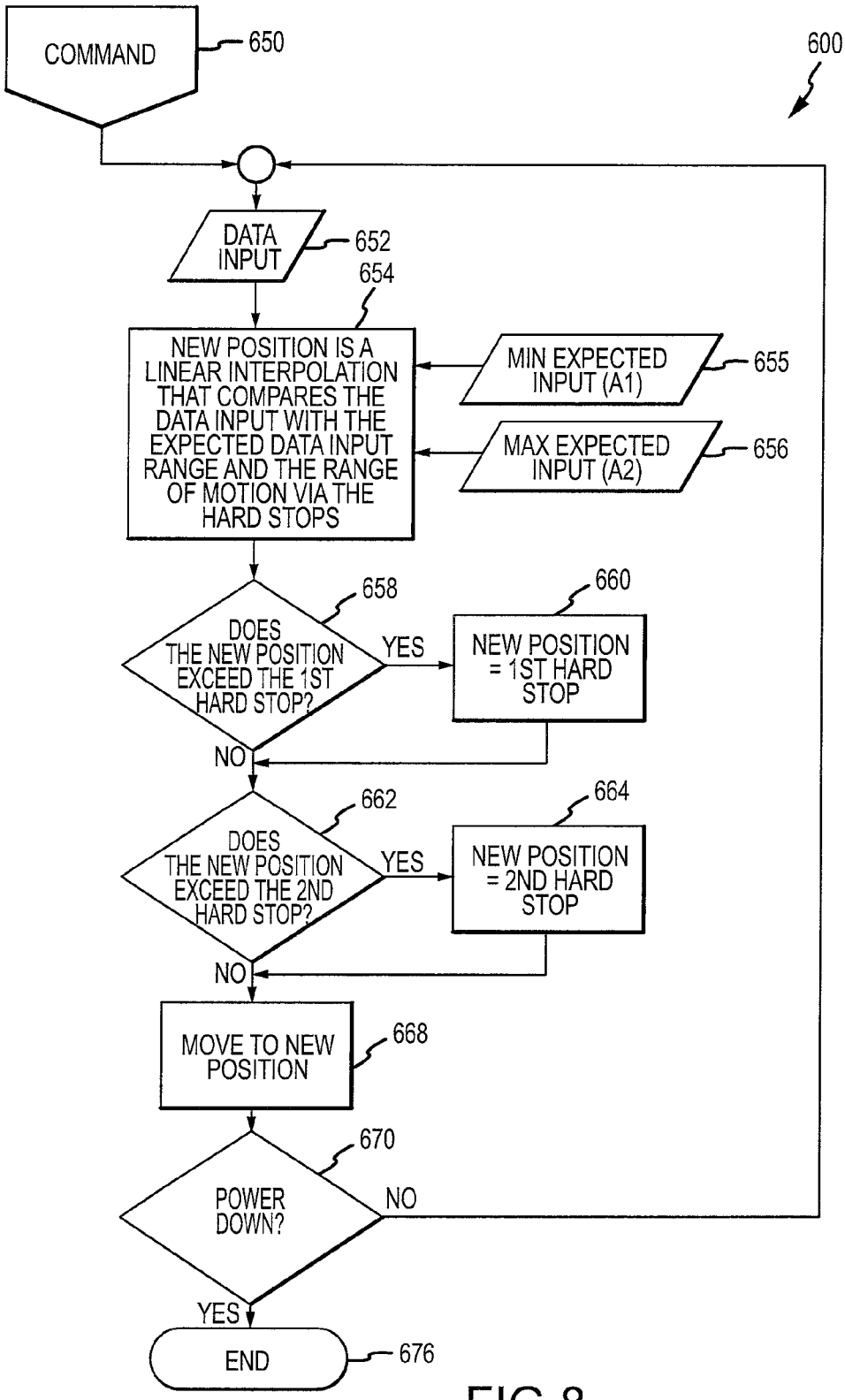

FIGS. 6-8 illustrate an actuator homing control programming method 600, e.g., the process used for homing the eyelid mechanism 500 and other similar assemblies with actuator embodiments of the invention (rather than conventional RC servos). The method 600 begins with the control system powering on at 610. At 612, the method 600 includes declaring and/or initializing a set of parameters/variables (shown as parameter set 614) including local and user defined parameters (e.g., user defined Offset 1 (OF1), user defined Offset 2 (OF2), first and second detection currents (DC1 and DC2), position errors (PE1 and PE2), expected minimum and maximum analog voltages (AI1 and AI2), and the like). At 616, the motor is turned on with the paddle and linked components in an arbitrary position. At 618, homing is configured to trigger on the optical encoder's next index value and at 620 paddle homing is initiated, with the homing process 624 shown to continue in FIG. 7.

At 626, the method 600 includes very slow rotation clockwise on the actuator motor. At 628, the method 600 includes determining whether the motor has rotated to the next encoder index and if not, the slow rotation continues at 626. If at the next encoder index, the method 600 continues at 630 with the motor's absolute position being set to zero. The method 600 next includes slowly rotating the motor in a counterclockwise direction at 632. At 634 (with variables 635 retrieved from memory including first detection current (DC1) and position error (PE1)), it is determined whether the current threshold and maximum position error has been reached and, if not, continuing the CCW motor rotation 632. If reached at 634, the method 600 continues at step 636 with the first hard stop (Stop1 shown at 638) being set equal to the motor's current position plus the user offset (OF1 shown at 637 plus a hard stop constant value such as 200). At 640, the method 600 then includes slow rotation of the motor in a clockwise direction and then at 652 determining whether a current threshold and maximum position error have been reached (with stored variables including detection current (DC2) and position error (PE2)). If not, the clockwise rotation is continued at 640, and if yes, the method 600 continues at 644 with setting the second hard stop (Stop2 shown at 648) equal to the motor's current position minus the second user offset (OF2 shown at 645) and minus a hard stop constant such as 200).

At 650, the method 600 continues with generating commands for the motor to operate within the set stops. At 652, analog or data input is received and at 654 a new position is determined that is a linear interpolation that compares the analog input with the expected analog voltage or data range and the range of motion via the set hard stops (based on variables including minimum expected input (A1 shown at 655) and maximum expected input (A1 shown at 656)). At 658, the method 600 includes determining whether the new position exceeds the first hard stop, and if so, at 660, the new position is set to be equal to the first hard stop. If not, the method 600 includes at 662 determining whether the new position exceeds the second hard stop. If so, at 664, the new position is set equal to the second hard stop, and if not, at 668, the motor is moved to the new position. At 670, the method 600 continues with determining whether or not to power down. If not, additional analog input is provided at 652 and further commanding steps 650 are performed. If power down is desired, the method 600 ends at 676.

Figure 9:
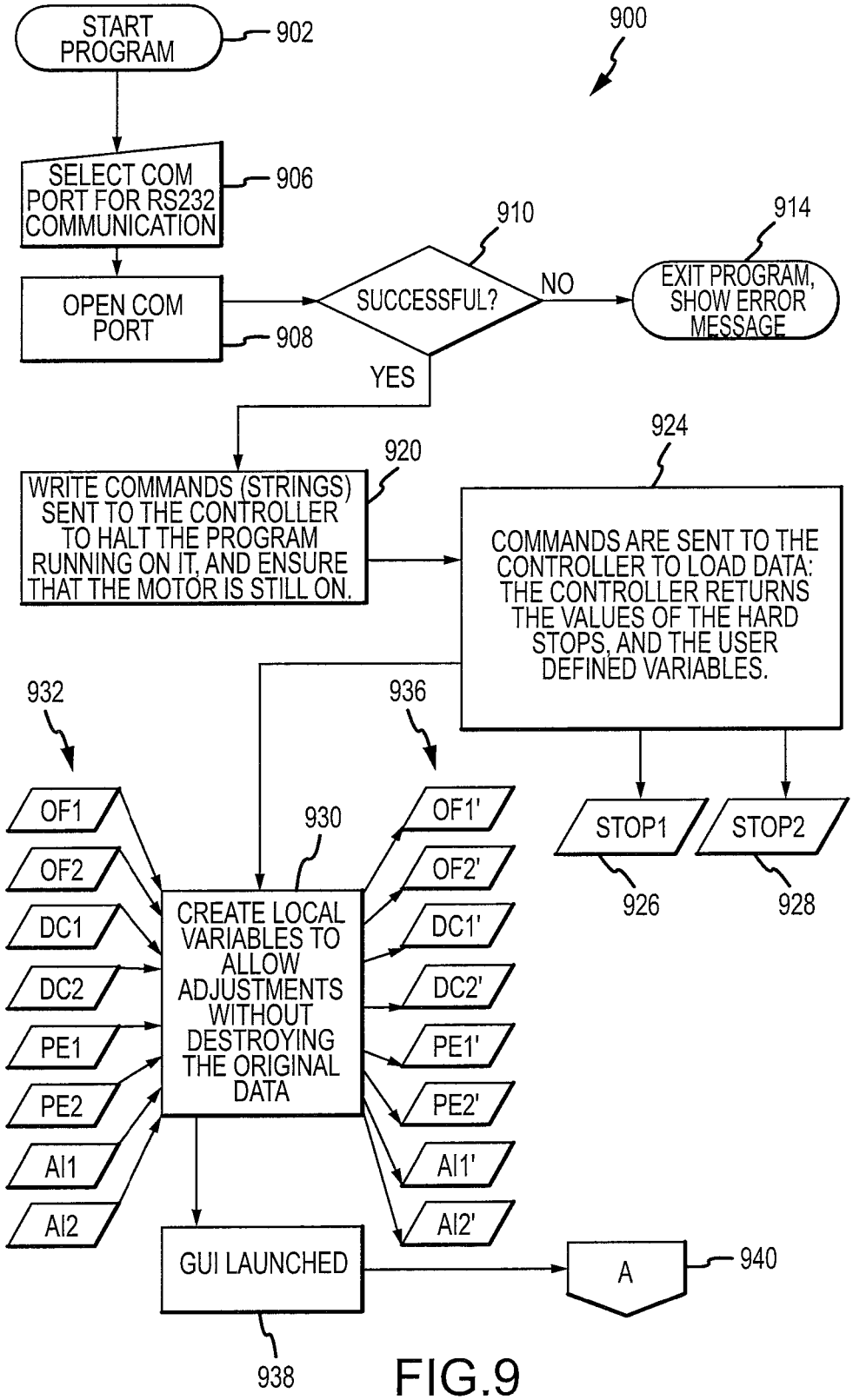
FIGS. 9 and 10 illustrate a fine-tuning process for an actuator including use of a user interface (e.g. a GUI).
Figure 10:
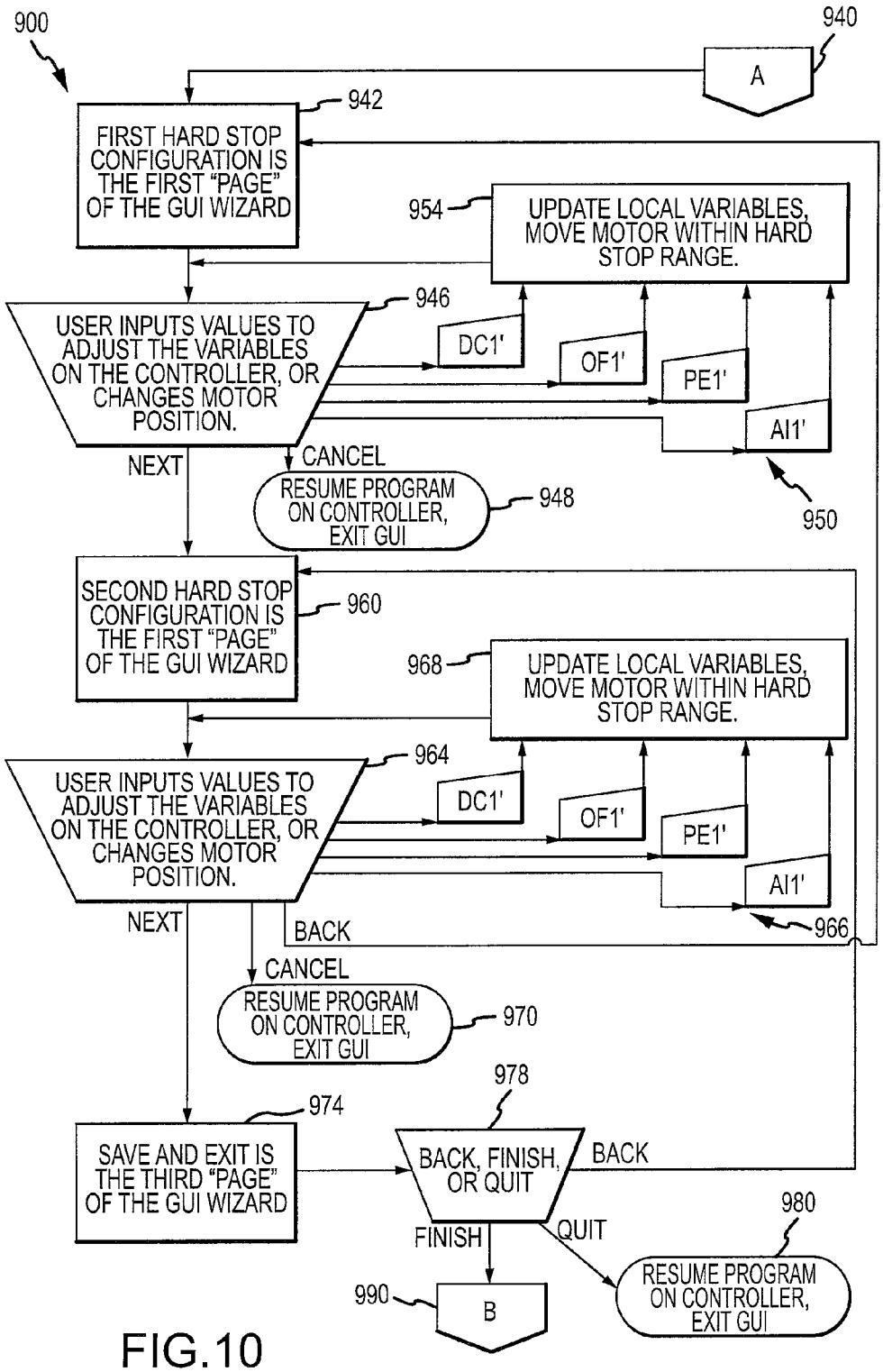

A further and optional process 900 is shown in FIGS. 9 and 10 that provides a "fine tuning" of the actuator's endpoints through the use of a GUI (e.g., a user interface provided by external or additional software run by the computer processor used for homing processes and for later storing configuration data in memory associated with the actuator in a worn costume, character head, or tethered/linked prop). For example, the GUI may be adapted to allow a user to change the value of the mechanical offset in real time for aesthetic or other purposes (e.g., to make movement of an eyelid or mouth more realistic or suit a particular character or a costume design or the like). Once the new offset values have been determined for clockwise and counterclockwise movement for a specific function or driven costume portion/feature, these values may be saved to non-volatile memory within the digital motion controller (or read by a control module from memory in a head or similar junction box). In some embodiments, the homing routine (as explained with reference to FIGS. 6-8) is performed each time a character head/control system are powered up such that the movements are consistent use-after-use to account for changes in operation that may occur over time with wear and use of a driven device and/or with an actuator. For example, when the homing routine is initiated at power-up of a worn costume with a performer-worn control system linked to a driver (such as actuator 400 or the like), the digital motion controller may execute an automatic routine to recreate the exact or substantially exact offset values (OF1 and OF2) for clockwise and counterclockwise motion. This allows an animated function such as eyelid or mouth movement to find each endpoint and to calibrate itself upon power up of the system/assembly.

With reference to FIGS. 9 and 10, the process 900 includes starting the program 902 and then selecting 906 and opening 908 a communication port. If opening of the communication port is determined successful at 910, the method 900 continues at 920 with write commands/strings being sent to the controller to halt the program running on it and ensuring that the actuator motor is still on. If the port was not successfully opened, the fine tuning program is exited at 914 including showing an error message on the GUI. At 924, the method 900 continues with commands being sent to the controller to load data. The controller may return the values of the hard stops and the user defined variables. The data read in some embodiments is in the form of strings followed by blank characters (e.g., unused part of the read buffer). Each of the parameters may be filtered and converted to integers or decimal values, with the output of step 924 being the two stop values (Stop1 and Stop2 shown at 926 and 928 in FIG. 9). At 930, local variables are created to allow adjustments without destroying the original data. These variables are shown as the original set 932 read from memory and the created local set 936. At 938, the GUI is launched and displayed on a monitor to the operator providing input for the fine tuning 900. The method 900 continues at 940 as shown in FIG. 10.

At 942, the first hard stop configuration is provides as the first page or window of the GUI (or GUI wizard). At 946, the operator or user provides input values to adjust one or more of the variable presently set or stored on the controller or changes the motor position. For example, the inputs may change the values of local variables as shown at 950. At 954, the local variables are updated and, if appropriate, the motor is moved within the hard stop range. The program 900 may also be cancelled by the user causing the GUI to be exited and control passed back to the controller at 948. At 960, a second hard stop configuration is provides as a second page/window of the GUI or GUI wizard. Again, the user is allowed to provide input to adjust the variables on the controller or to change the motor position at 964 as shown local variable inputs 966. If appropriate based upon received user input via the GUI, at 968, the method 900 includes updating the local variables and moving the motor within the hard stop ranges. The user may cancel the fine tuning 900 and at 970 the GUI may be exited and control returned to the program run by the controller (e.g., the control module). At 974, the method 900 includes presenting the user/operator a third page/window where the user may indicate that the changed values of the variables should be saved and/or the program should be exited. At 978, the GUI-based method 900 may continue at 960, may finish at 990 with saving the data (e.g., saving user-defined variables to non-volatile memory on the controller or accessible by the controller) and terminating, or a cancel selection may be made by the user causing the GUI to be exited at 980 and control passed back to the controller/control module.

The actuators described with reference to FIGS. 4-10 provide a number of advantages over prior drivers. Previously, RC servos were used in costumes and character heads but had numerous disadvantages including being noisy, generating heat, providing limited reliability, and often being inaccurate in their proportional responses. Others have utilized bulky and expensive electro-hydraulic or electro-pneumatic systems to produce the power density needed for lifelike animation. Further, these actuation solutions often required an absolute feedback device such as a potentiometer, linear displacement transducer, or Hall effect sensor to be mounted on the actuator or moving device, and the additions of these sensors added to the overall wire count, cost, volume, and weight of the actuator. Some have used rotational electromechanical devices with incremental encoders, but these implementations typically required limit switches or absolute encoders to establish the home position of the actuator. Hard stop homing has been used with a number of devices but these hard stops were not integral to an actuator and were not easily reconfigurable or exchangeable.

The actuators embodiments discussed with reference to FIGS. 4-10 address a number of these issues with prior actuators. The described actuators do not require adding additional wires or conductors for absolute homing. The actuators weigh less and have less infrastructure when compared to electro-hydraulic or electro-pneumatic systems. The machined stop "puzzle piece" allows a range of motion to be easily selected by exchanging the stop assembly for one with differing range of motion (e.g., one with 40 degrees for one with 65 degrees or the like) without having to disassemble the attached load (e.g., a linkage to an animated function). The stop assembly may be machined from a stop blank for any needed or desired range of motion. The paddle or arm may be uniform and consistent for each actuator to allow for a standardized design to be used in many different applications. Software in the digital motion controller may be adapted to automatically execute a routine/module to home the actuator using the integral hard stops. The range of motion may be further adjusted (e.g., fine tuned) through software/GUIs for extremely accurate and/or selectable positioning of the end points of travel for the motor upon motion commands (and for the linked costume/head feature).

Once calibrated, the range of motion of the actuator is accurate and repeatable upon every power up sequence. The actuator design provides a driver that is virtually maintenance free due to self calibration functionality upon each power up (in some embodiments). Technicians/operators do not have to readjust end points because the range of motion is built into the system hardware and software. The actuator has higher reliability and duty cycle than RC servos and other existing drivers due to use of industrial components for the motor and other components. The actuators are quieter than prior drivers used in worn costumes, which facilitates use of the worn costume and control system in closer proximity to audience members. The actuator mounting may be chosen to match the existing hole pattern(s) and volumetric restraints of existing drivers such as RC servo motors to support inexpensive prototyping (utilizing readily available RC servos that can later be changed out) and to support direct retrofits on existing/in use equipment. Note, the actuator may be used in the costume systems and character heads as described above (e.g., be used as the driver in the embodiments of an entertainment system with worn costumes/character heads). Additionally, the actuator may be used in other applications such as entertainment/display applications such as animatronics, lighting effects, window displays, puppets, and the like and may also be used in non-entertainment applications such as in hobby applications (e.g., remote controlled boats, cars, airplanes, and the like), robotics, aerospace systems, defense applications, artificial limbs/prosthetics/biomedical devices, and optics/photonics/projection systems.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

While not limiting to the invention, it may be useful to provide examples of some specific attributes and dimensions of one embodiment of a performer-worn control system and components that may be provided in a character head (and controlled by the control system). The character controller may be mounted in a belt pack worn by a performer. The controller's enclosure may be implemented as three small enclosures/modules with flexible interconnections. The belt pack enclosure(s) may be adaptable to front-waist or rear-waist mounting. The battery power source module may be configured to provide a single external connector that provides power to all the worn control system components. To support mounting on the performer belt pack, the battery module may be constructed of multiple battery sub-modules or may be made of individual battery packs that are interconnected, with a battery pack including one or multiple cell batteries. The battery module may also be split into two sub-modules, four battery packs, and so on.

The wire harness generally is adapted to contain all wires needed to connect signals from character controller to other costume locations such as a head junction box and arm switches, and the back harness between the controller and the splitter box (if used) and/or head junction box may be formed of a ribbon cable and/or flex circuit type. The wire harness connectors typically are of a quick connect/disconnect locking type (e.g., such that tools typically are not required). In some cases, arm mounted control switches are provided that may include two manual switches and enclosures (one each mounted on a forearm of the left and right arms of a performer) with tactile feedback to allow a performer know when a change in a switch position has occurred. One switch may be used to provide a master power disable function and the other may be wired to a character control input and allow the performer to toggle between stored data playback mode and local puppeteering control. In some systems, there are at least two manual analog puppeteer controls (one each mounted on a finger of the left and right hand of the performer), and these controls are removable and adapted to allow character control (when in the local or puppeteer mode of operation/control). Each control is typically mapped in software run by the character controller to any exclusive combination of the motor/driver axes, and each finger control is used to control an actuator/driver (or combination thereof) to move throughout full range(s) of travel. In some embodiments, each finger control provides an analog signal to the character controller which may be provided by one of the following: a two-conductor Flexpoint Bend Sensor, Model 2000-2001 or the like; a three-conductor, bidirectional Flexpoint Bend Sensor; a three-conductor wiper style potentiometer (e.g., with nominal resistance of 10 k Ohms or the like).

In a character head application, a junction box is typically mounted in the character head. The junction box may contain connectors/receptacles to mate with 1 to 3 or more actuators, with each actuator typically having a motor power connector and a feedback signal connector. Generally, the junction box provides a connection point for the head-mounted actuators' motors and encoder cables as well as for the body wire harness quick disconnect. The box typically contains feedback signal electronics, non-volatile memory components for storing head serial number and motor parameters, and a memory interface. The junction box may include a connector/receptacle for each actuator motor and also a connector/receptacle for each actuator feedback. A connector or connectorized pigtail may be provided for the body wire harness, e.g., a quick-disconnect type connector that is used each time the character head is placed on a performer who is wearing the performer-worn control system. The junction box may also include line driver electronics or other useful outputs.

The junction box contains non-volatile memory that may be read and written to by the controller module. The memory may store configuration parameters associated with the particular head. These parameters are read by the controller at startup, and the parameters may include manufacturing constants such as endpoint offsets, measured sizes, and the like. More particularly, the stored parameters typically include unique manufacturing serial number and/or a character ID and also tuning parameter for each/all of the drivers (e.g., acceleration, commutation array, current continuous limitations, motor stuck protection parameters, deceleration, encoder filter frequency, velocity error limit, position error limit, gain scheduling, over-speed limit, position range limit, gain scheduled controller parameters, integral gain, proportional gain, low feedback limit, peak duration and limit, communication settings, stop deceleration, smooth factor, speed, sampling time, hard stop offset values, hard stop current thresholds, high and low reference limit, firmware version, over-current proportional gain, and the like.

The character controller or performer-worn control system may include a wireless data interface. In some embodiments, the wireless network does not allow unauthorized clients to connect to the network. As only the character controllers registered in a given network can be communicated to, this allows venues to overlap while insuring each character controller is able to interpret show data or synchronization packets that are intended for characters located at that specific venue only. In remote data modes, the data link allows the broadcast of real-time data including show control data and may involve communicating with multiple character controllers concurrently. In show playback mode, show control data is broadcast that may include a show identifier and a show time code, and the show control data may be transmitted to all the character controllers on the network. In one exemplary embodiment, the data link utilizes the RF Monolithics LPR2400 (e.g., 2.4 GHz, 1 mW, 16 channel, 250 kbps) and incorporates a 0 dBi omnidirectional antenna.

The off-stage or wayside controller interface may take a number of forms to provide the functions described herein. For example, it may include an input port to accept DMX-512 data for use in the remote data mode, and it may further include a high impedance, balanced analog input port for reception of SMPTE, EBU, or other time codes in order to allow synchronization during playback of locally stored show data in show playback mode. The off-stage controller or interface may be able to read time code such as code with a frame format of 25 or 30 fps and a frame rate of 25, 29.97, 30 fps or the like (and, in some cases, drop frame format is accommodated as well). The wireless data link used by the off-stage controller interface may incorporate a 0 dBi omnidirectional antenna or other useful antenna. The interface may include a bi-directional data port allowing an external computer connection for: registering character controller devices on/off the wireless network; retrieving status from remote character controllers (e.g., retrieving serial number and character ID for character controller and character head attached to the character controller, error conditions, current mode of operation, battery status, controller temperature, and the like); acting as a wireless bridge to the character controller devices, which also allows timing synchronization and real time show data input to be transferred to the character controllers; configuration of the off-stage wayside controller including configuring the remote data mode and the show playback mode; and information via a data port to accept real-time show data such as via an Ethernet connection.

The character controller may have at least one connection/receptacle port to the wire harness and may have at least one connection/receptacle port for the battery power source. The controller may include switch input such as to allow a technician or performer to toggle between left/right hand finger sensor preferences, to allow a utilization of a manual finger sensor calibration routine stored in controller memory, and the like. The software/firmware provided as part of the control module is adapted to perform a number of functions as discussed above. Upon initialization, the control module queries the head junction box electronics for configuration parameters and continues to periodically poll if no head/junction box is found. The control module loads the configuration parameters (including servo or driver configurations) from internal non-volatile memory and uses the parameters now stored in the controller's local memory to configure and initialize the servo drivers.

For example, an automatic homing routine may be used to determine each actuator encoder's measured (e.g., software or soft) travel limits, and this homing routine may run when the encoder position is not known such as at reset or power up and may measure each actuator's motor current to determine when the actuator reaches the CW and CCW travel limit hard stops. A default or initial operation mode for the control module may be provided in the configuration data (such as local puppeteering mode and so on). In show playback mode, each axis position is commanded by show data that has previously been stored in the character controller memory. In this mode, a remote time code is received by the wayside controller or off-stage controller interface via the wireless link. In one exemplary embodiment, to play a show synchronized to remote time code, the off-stage controller streams appropriate show data based on the SMPTE hour. The character controller stores show content or pre-scripted sets of motion commands used to drive/control the actuators, and this show data typically includes show data for multiple characters in a given show and for multiple shows. The show data is then retrieved based on the show being performed (as identified/defined in the show control signal) and based on the character ID (retrieved from the head or other costume junction box memory).

We claim:

1. A method for operating and controlling a driven output device provided in an articulated character head, mobile prop, puppet, or other object worn or carried by a live actor or performer, comprising:

providing a control system wearable by the performer, the control system including at least one driver for the output device, a show control module, a wireless transceiver, memory, and power source;

storing a set of commands for the output device in the memory;

receiving a synchronization signal with the wireless receiver from a wayside controller remote from the performer-worn control system; and operating the control module to process the show control signal, to retrieve the set of commands from the control system memory, and to signal the driver to drive the output device based on the set of commands, wherein the show control signal comprises motion control data from the wayside controller, wherein the show control signals include timing codes, wherein the signals to operate the driver are synchronized in time using the timing codes, and wherein the wayside control device freewheels at a predetermined or preset frame rate when upstream time codes are unavailable.

2. The method of claim 1, further comprising storing additional sets of commands in the control system memory, wherein each of the sets of motion commands is associated with a single show entity and wherein the operating of the control module includes identifying the show entity associated with the control system and retrieving from memory the set of commands associated with the identified show entity.

3. The method of claim 2, further comprising communicatively linking the control system with a memory device associated with the output device and wherein the identifying of the show entity comprises retrieving a character identifier from the memory associated with the output device.

4. The method of claim 3, wherein the memory associated with the output device is local to the output device and further stores a set of tuning parameters defining operation of the output device and wherein the operating of the control module further comprises driving the output device based on the tuning parameters.

5. The method of claim 4, wherein the output device comprises a driven actuator and wherein the driver is selected form the group of drivers consisting of a motor driver, a prop driver, a light control driver, a stage pyrotechnic driver, audio driver, and a valve driver.

6. The method of claim 1, further comprising receiving signals from the wayside controller modifying the set of commands stored in the memory, whereby the wayside controller is operable to program operation of the control system.

7. A method for operating and controlling a driven output device provided in an articulated character head, mobile prop, puppet, or other object worn or carried by a live actor or performer, comprising:

providing a control system wearable by the performer, the control system including at least one driver for the output device, a show control module, a wireless transceiver, memory, and power source;

storing a set of commands for the output device in the memory;

receiving a synchronization signal with the wireless receiver from a wayside controller remote from the performer-worn control system;

operating the control module to process the show control signal, to retrieve the set of commands from the control system memory, and to signal the driver to drive the output device based on the set of commands;

storing additional sets of commands in the control system memory, wherein each of the sets of motion commands is associated with a single show entity and wherein the operating of the control module includes identifying the show entity associated with the control system and retrieving from memory the set of commands associated with the identified show entity; and communicatively linking the control system with a memory device associated with the output device and wherein the identifying of the show entity comprises retrieving a character identifier from the memory associated with the output device, wherein the show control signal comprises motion control data from the wayside controller, wherein the memory associated with the output device is local to the output device and further stores a set of tuning parameters defining operation of the output device and wherein the operating of the control module further comprises driving the output device based on the tuning parameters, wherein the output device comprises a driven actuator and wherein the driver is selected form the group of drivers consisting of a motor driver, a prop driver, a light control driver, a stage pyrotechnic driver, audio driver, and a valve driver, and wherein the driven actuator comprises a rotary motor with a modular hard stop element and soft offsets defining a distance from each of the hard stops.

8. The method of claim 7, wherein the tuning parameters include the soft offsets defining a range of motion for the motor driven actuator.

9. A system for controlling operation of costumes and props with mechanized or other remotely drivable portions, comprising:

a remote control assembly including means for generating timing signals, means for providing control signals based on user input, and means for generating wayside control signals in response to the timing signals or the user input-based control signals, wherein the generated wayside signals operate a drive mechanism for the drivable portions based on locally processed ones of the wayside signals including scripted motions synchronized using the timing signals, and wherein the remote control assembly further includes means for querying a controller of the drive mechanism for operating status updated for the drive mechanism or for the drivable portions.

10. The system of claim 9, wherein the controller the drive mechanism based on a character ID stored in memory associated with a costume or tethered prop attached to the costumes or the props.

11. A system for controlling operation of costumes and props with mechanized or other remotely drivable portions, comprising:

a remote control assembly including means for generating timing signals, means for providing control signals based on user input, and means for generating wayside control signals in response to the timing signals or the user input-based control signals, wherein the generated wayside signals operate a drive mechanism for the drivable portions based on locally processed ones of the wayside signals including scripted motions synchronized using the timing signals, and wherein the means for generating the wayside control signals is adapted to freewheel at a predetermined frame rate when the timing signals are unavailable.

12. A method for operating and controlling a driven output device provided in an articulated character head, mobile prop, puppet, or other object worn or carried by a live actor or performer, comprising:

providing a control system wearable by the performer, the control system including at least one driver for the output device, a show control module, a wireless transceiver, memory, and power source;

storing a set of commands for the output device in the memory;

receiving a synchronization signal with the wireless receiver from a wayside controller remote from the performer-worn control system; and operating the control module to process the show control signal, to retrieve the set of commands from the control system memory, and to signal the driver to drive the output device based on the set of commands, wherein the show control signal comprises motion control data from the wayside controller and wherein the wayside controller, wirelessly or via wireless RF link, queries the show control module to obtain status updates for the driven output device or for the control system.

13. The method of claim 1, wherein the show control signals are provided by the wayside controller via RF transmissions to the control system concurrently with transmission of the RF transmissions to additional ones of the control systems.

14. The method of claim 12, further comprising storing additional sets of commands in the control system memory, wherein each of the sets of motion commands is associated with a single show entity and wherein the operating of the control module includes identifying the show entity associated with the control system and retrieving from memory the set of commands associated with the identified show entity.

15. The method of claim 14, further comprising communicatively linking the control system with a memory device associated with the output device and wherein the identifying of the show entity comprises retrieving a character identifier from the memory associated with the output device.

16. The method of claim 15, wherein the memory associated with the output device is local to the output device and further stores a set of tuning parameters defining operation of the output device and wherein the operating of the control module further comprises driving the output device based on the tuning parameters.

17. The method of claim 16, wherein the output device comprises a driven actuator and wherein the driver is selected form the group of drivers consisting of a motor driver, a prop driver, a light control driver, a stage pyrotechnic driver, audio driver, and a valve driver.

18. The method of claim 17, wherein the driven actuator comprises a rotary motor with a modular hard stop element and soft offsets defining a distance from each of the hard stops.

19. The method of claim 18, wherein the tuning parameters include the soft offsets defining a range of motion for the motor driven actuator.

20. The method of claim 12, wherein the show control signals include timing codes and wherein the signals to operate the driver are synchronized in time using the timing codes.

21. The method of claim 20, wherein the wayside control device freewheels at a predetermined or preset frame rate when upstream time codes are unavailable.

22. The method of claim 12, further comprising receiving signals from the wayside controller modifying the set of commands stored in the memory, whereby the wayside controller is operable to program operation of the control system.

23. A wearable apparatus for enhancing control of an articulated head that includes an actuator for moving an animated device portion of the head such as the mouth or eyes, comprising:

a wireless receiver receiving show control signals including time synchronization data;

a data storage device storing show data defining a set of prerecorded movements;

a driver adapted for driving the actuator; and a control module processing the show control signals to operate the driver based on the show data to operate the actuator to perform the set of prerecorded movements synchronized with the time synchronization data, wherein the articulated head memory further stores configuration data related to operation of the actuator and wherein the control module operates the actuator to perform the set of prerecorded movements based on the stored configuration data.

24. The apparatus of claim 23, wherein the show data comprises a set of prerecorded movements for a plurality of character heads and a character ID and wherein the control module selects the set of prerecorded movements to operate the actuator based on the character ID associated with one of the character heads.

25. The apparatus of claim 23, further comprising a sensor operable by performer to provide an analog input signal and wherein the control module operates in a local control mode to process the analog input signal and, in response, to operate the driver to drive the actuator.

26. The apparatus of claim 23, further comprising at least one power storage device providing power to the control module and the driver.

* * * * *

UNITED STATES PATENT AND TRADEMARK OFFICE

CERTIFICATE OF CORRECTION

PATENT NO. : 8,517,788 B2
APPLICATION NO. : 13/742509
DATED : August 27, 2013
INVENTOR(S) : Eck et al.

It is certified that error appears in the above-identified patent and that said Letters Patent is hereby corrected as shown below:

On the title page item [75], the name of the second-named inventor should be changed from "William J. Wiedefeld" to "William G. Wiedefeld".

Signed and Sealed this
Eighth Day of April, 2014

Michelle K. Lee

Michelle K. Lee
*Deputy Director of the United States Patent and Trademark Office*